US006889779B2

(12) United States Patent
Skarlupka, IV et al.

(10) Patent No.: US 6,889,779 B2
(45) Date of Patent: May 10, 2005

(54) AUGER/VEHICLE INTERFACE JIG

(76) Inventors: Joseph Henry Skarlupka, IV, N6593 Lake Crest Dr., Cecil, WI (US) 54111; Kara Jean Skarlupka, N6593 Lake Crest Dr., Cecil, WI (US) 54111

( * ) Notice: Subject to any disclaimer, the term of this patent is extended or adjusted under 35 U.S.C. 154(b) by 97 days.

(21) Appl. No.: 10/223,448

(22) Filed: Aug. 19, 2002

(65) Prior Publication Data

US 2004/0031617 A1 Feb. 19, 2004

(51) Int. Cl.[7] ..... E21B 7/00
(52) U.S. Cl. ..... 173/184; 173/28; 173/148
(58) Field of Search ..... 173/44, 45, 128, 173/139, 198, 152, 185, 184

(56) References Cited

U.S. PATENT DOCUMENTS

| | | | | | |
|---|---|---|---|---|---|
| 2,239,024 | A | * | 4/1941 | Vance | 175/162 |
| 2,474,981 | A | * | 7/1949 | McCardell | 173/145 |
| 2,522,848 | A | * | 9/1950 | Talbot | 173/25 |
| 2,562,276 | A | * | 7/1951 | Kandle | 175/203 |
| 2,565,224 | A | * | 8/1951 | Gibbens | 173/40 |
| 2,593,245 | A | * | 4/1952 | Beck et al. | 173/40 |
| 2,602,637 | A | * | 7/1952 | Talbot | 173/25 |
| 2,660,035 | A | * | 11/1953 | Zeiser | 173/185 |
| 2,723,835 | A | | 11/1955 | Reese | |
| 2,774,568 | A | * | 12/1956 | Jones | 173/140 |
| 3,367,427 | A | * | 2/1968 | Baumgardner | 173/185 |
| 3,602,321 | A | | 8/1971 | Kortschaga | |
| 3,700,045 | A | * | 10/1972 | Coontz | 173/26 |
| 3,731,751 | A | | 5/1973 | Rusco | |
| 4,161,988 | A | * | 7/1979 | Hart | 173/32 |
| 4,316,393 | A | * | 2/1982 | Philipenko | 73/864.45 |
| 5,090,486 | A | * | 2/1992 | Jones | 173/26 |
| 5,303,857 | A | * | 4/1994 | Hewson | 224/506 |
| 5,330,014 | A | | 7/1994 | Wagner | |
| 5,363,925 | A | * | 11/1994 | Gallagher | 173/186 |
| 5,394,949 | A | * | 3/1995 | Wright et al. | 175/20 |
| 5,507,354 | A | * | 4/1996 | Harleman | 175/162 |
| 5,542,476 | A | * | 8/1996 | Hansen | 172/22 |
| 5,556,217 | A | * | 9/1996 | Deyo et al. | 403/61 |
| 5,836,402 | A | * | 11/1998 | Jones | 173/185 |
| 5,950,741 | A | * | 9/1999 | Wright et al. | 175/20 |
| 5,975,831 | A | | 11/1999 | Martin | |
| 6,056,065 | A | * | 5/2000 | Campbell et al. | 172/42 |
| 6,076,617 | A | | 6/2000 | Berner | |
| 6,155,771 | A | | 12/2000 | Montz | |
| 6,260,633 | B1 | * | 7/2001 | Machek et al. | 175/20 |

FOREIGN PATENT DOCUMENTS

| | | |
|---|---|---|
| CA | 908651 | 8/1971 |

OTHER PUBLICATIONS

Andre' Montz—http://www.ezupngo.com/.

* cited by examiner

*Primary Examiner*—Eugene Kim
*Assistant Examiner*—Paul Durand
(74) *Attorney, Agent, or Firm*—Lisa A. Brzycki; Gehrke & Associates, SC

(57) ABSTRACT

An interface jig for removably securing a portable auger to a vehicle includes a carriage guide assembly, a sliding carriage assembly and a receiver assembly. The carriage guide assembly includes a vertical support having an upper portion and a bottom portion. A hitch adapter is affixed to the bottom portion to secure the carriage guide assembly to a vehicle hitch receiver. The sliding carriage assembly includes a horizontal member having a first end opposite a second end. The first end Is affixed to a vertical member that slides along the vertical support between the upper portion and the lower portion of the carriage guide. The receiver assembly is attached to the second end of the sliding carriage assembly.

6 Claims, 14 Drawing Sheets

AUGER/VEHICLE INTERFACE JIG

CROSS-REFERENCE TO RELATED APPLICATIONS

| CROSS-REFERENCE TO RELATED APPLICATIONS | | | |
|---|---|---|---|
| 2723835 | November 1955 | Reese | |
| 3602321 | August 1971 | Kortschaga | 175/18 |
| 3731751 | May 1973 | Rusco | |
| 5363925 | November 1994 | Gallagher | 173/186 |
| 5836402 | November 1998 | Jones | 173/185 |
| 6076617 | June 2000 | Berner | 175/18 |
| 5330014 | July 1994 | Wagner | 175/18 |
| 6155771 | December 2000 | Montz | 414/543 |

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of Invention

The present invention relates to devices for attaching auger type devices to vehicles for the purpose of easy and safe transportation of the auger and then to provide support and control of the auger during operation whether this operation is initiated remotely, from the vehicle, or locally in reference to the auger.

2. Description of the Prior Art

Throughout history man has found a need to excavate small diameter holes in the earth's surface for the multiple purposes ranging from dwelling erection, securing livestock and the gathering of food. This surface can include both soil and ice, ice, which forms on the surface of lakes, streams and ponds during winter. Today there are many types of devices; both self-powered and manually operated which were designed for excavating such holes. Whereas these devices work well for what they were designed to do, which is to drill a small diameter hole in either earth or ice, they generally require excessive manual effort to transport and utilize.

The effort required to transport and utilize the available portable auger devices can expel a significant toll on the user. When using these devices there is generally excessive manual effort associated with their implementation. This will cause undo stress to the human body and will lessen the production and lengthen the time required to perform the task at hand. This also limits the use of such devices to only those people physically capable of performing such functions. There have been several devices designed to assist the user in the transportation and utilization of auger devices but due to their design tend to be bulky, expensive to manufacture and therefore purchase and require far more labor from the user to install and operate than necessary.

The devices available today are designed to assist the user in the transportation and utilization of the auger but still fall short of the essential goal of taking the work out of drilling a small diameter hole. Some of these devices do not address the transportation of the auger but solely assist the user with the operation of the auger, such as U.S. Pat. No. 3,602,321 (1971, Kortschaga) teaches the use of an auger powered by the clutch pulley of a snowmobile. U.S. Pat. No. 3,731,751 (1973, Rusco) teaches the use of an auger powered by the track of a snowmobile. These devices require added assembly time and energy and can often be dangerous to use due to the open moving parts associated with the assembly and operation of the apparatus. Since operation of the auger is in the outdoor environment thick clothing and gloves could be required to keep the individual warm, dry and safe. Such bulky clothing and gloves can get caught in the open moving parts. It is also difficult for someone wearing such clothing to set up devices requiring the manipulation of small parts or to operate a device that requires precise movements. Another problem associated with these devices is that they take up space in the cargo rack of the supporting vehicle and/or must be secured to the user's vehicle during transportation and then requiring additional assembly once onsite. This requires time and the expenditure of energy, thus detracting from the safety and fulfillment of the task at hand.

U.S. Pat. No. 2,723,835 (1954, Reese) teaches a frame for supporting a motor-driven ice hole cutter. The frame of the Reese device rests on the top surface of the ice. The frame has prongs that are inserted into the ice in order to further secure the frame while operating the ice cutter. The motor of the cutter is secured to a platform carried by the frame for vertical movement. The Reese device also has a windlass journalled in the frame and has a hoisting rope secured to the platform for raising the platform and the parts associated therewith after the ice hole has been cut.

The Reese device fails to address many of the problems associated with the stabilization, transportation and operation of the auger. While the Reese device may provide more stability than a hand-held auger, the device may still twist or loosen, depending on the vibration and torque exerted when drilling through the ice. The Reese device must be assembled and disassembled each time a new hole is drilled. The device takes up space on the vehicle and likely must be secured during transportation. The operation of the Reese device becomes more difficult because of the setup time required to secure the pins in the ice and the rope-pulley means for retracting the auger from the hole.

U.S. Pat. No. 5,836,402 (1998, Jones) teaches a frame for securing and supporting an auger device to a vehicle by means of additional bracketry. The Jones device supports the auger during transportation and operation of the drilling process. The Jones device is designed to be adaptable to most vehicles including ATV's (All Terrain Vehicles) and snowmobiles, with the use of custom designed bracketry. The problem with this design as it relates to securing it to a vehicle is that it not only requires custom designed bracketry to secure the Jones device to a vehicle but also requires additional brackety to stabilize the Jones device and therefore the auger it supports during the transportation process and the hole drilling operation of the auger unit. This additional supporting bracketry not only adds additional weight which must be carried by the supporting vehicle but also adds an additional cost to the user in both monetary terms when purchasing the Jones device and in time spent in assembling the Jones device to the supporting vehicle.

The Jones device also states the ability to adapt to varying handle sizes and widths of multiple pre-manufactured powered auger devices. The problem with this design as it relates to the ability to adapt to multiple pre-manufactured augers is that the entire apparatus of the Jones design must be physically adjusted, most likely requiring tools, to accommodate differing auger unit widths rather that just adjusting the portion of the unit that supports the powered auger device or having an auger supporting unit that automatically adjusts to the varying handling sizes and widths of multiple pre-manufactured powered auger devices. Since set-up and assembly of the Jones device is likely to be done in an unheated garage or outdoors, thick clothing and gloves could be required to keep the individual warm, dry and safe. Such bulky clothing and gloves can make it difficult to make such adjustments required by the Jones device not to mention it also adds weight, bulk, cost and time to the end-user.

Therefore what is needed is an auger/vehicle interface jig that can be easily secured to, transported by, and operated from various types of vehicles, including ATV's and snowmobiles, without the need for customized vehicle attachment or additional customized stabilizing bracketry, therefore allowing the unit to be lightweight, streamlined, and inexpensive to manufacture, requiring minimal effort from the end user to install. What is further needed is an auger/vehicle interface jig that permits full use of the vehicle's cargo rack. What is still further needed is a device that allows an individual to easily raise and lower the auger when drilling a hole. What is still further needed is an auger/vehicle interface jig that can easily be adapted to multiple pre-manufactured augers requiring no disassembly or adjustments to the unit at any point.

BRIEF SUMMARY OF THE INVENTION

It is an object of the present invention to provide an auger/vehicle interface jig that can be secured to a vehicle frame at a single point or by using a standard after-market square tubular style vehicle hitch which requires no additional custom securing or stabilizing bracketry for the purpose of transporting said unit and associated pre-manufactured auger. It is another object of the present invention to provide an auger-mounting device that permits the installation of pre-manufactured augers of varying handle dimensions and widths that requires no tooling or adjustments to be made to the auger or the invention. It is another object of the present invention to provide an auger-mounting device that permits the auger to be operated while secured to a vehicle. Yet another object of the present invention is to provide an auger/vehicle interface jig that can be transported by a vehicle without limiting the normal use of the vehicle's cargo rack or requiring supplemental means for securing the auger device. Another object of the present invention is to provide an auger/vehicle interface jig that will assist a single person in the act of drilling and then retracting the auger during the normal operation of drilling a hole. Yet another object of the present invention is to provide an auger/vehicle interface jig that is easy to install and operate while wearing thick clothing and gloves.

The auger/vehicle interface jig of the present invention includes a vertically standing carriage guide assembly, a sliding carriage assembly and an automatically adjusting auger receiver assembly. The carriage guide assembly includes a means for securing the auger/vehicle interface jig to a vehicle via a standard after-market square tubular style vehicle hitch. The sliding carriage assembly is then joined with the carriage guide assembly in such a manor that allows for the up and down vertical movement of the sliding carriage assembly along the vertical support member of the said carriage guide assembly. The automatically adjusting auger receiver assembly includes a means for securing an auger and is then attached to the sliding carriage assembly. The sliding carriage assembly is supported by an assistive operational means such as but not limited to a cable and winch or cable and spring device and can be secured in the up most position for the purpose of long distance transportation by inserting a single transport locking pin. The carriage guide assembly may include a means for adjusting the vertical support member of the carriage guide assembly, and therefore the auger, in relation to the terrain.

The auger/vehicle interface jig may be used to secure many sorts of hole digging equipment including but not limited to post hole drill/augers and ice augers. For earth drilling type augers the carriage guide assembly of the present invention can be adjusted for the present terrain as to accommodate the pitch of a hill in order to align the postholes vertically when operating the vehicle up or down the face of a hill. For ice drilling type augers the adjustable capabilities of the present invention would not generally be necessary for the ice auger to drill a hole perpendicular to the plane of the ice, but the distinguishing feature may occasionally be useful when pressure ridges cause the ice to become uneven and non-flat. Finally, it is an object of the present invention to provide an auger/vehicle interface jig that automatically adjusts to various types of augers, is adjustable for use on various types of terrain and that requires minimal effort and cost from the end-user to install and operate.

An obvious advantage of this invention is the ability to easily secure an auger to a vehicle and then to drive it to any location where a hole is to be drilled and then to drill the hole without any further installation or adjustment of the present invention or auger. Due to the simplistic design of the invention another advantage of the present invention is its ease of installation onto any vehicle equipped with a standard after-market square tubular style vehicle hitch. The unit is secured and then removed from the vehicle's hitch by inserting and then removing a single hitch pin. The standard after-market square tubular style vehicle hitch used by the present invention is a common after-market accessory obtainable by the user from many vehicle related retail outlets. The advantage of this design provides for maximum strength and stability of the present invention while minimizing the weight of the unit and therefore manufacturing costs. Another advantage due to the design of the present invention is the ease of storing the unit when not in use; its slim design allows the user to store the unit in locations unavailable to prior invention designs, which are more bulky and heavy in nature. Another advantage arises because the auger is capable of being operated while attached to the vehicle. Again, because of the simplistic design of the present invention it allows one to secure, transport, and operate the auger without the need of any customized securing and stabilizing bracketry, unlike other designs that do which typically involves the use of the vehicles cargo rack. This allows the user to take full advantage of the vehicle's cargo rack. A further advantage of the invention is to facilitate the drilling of the hole and retracting the auger from the hole after it has been drilled. This may be accomplished by using assistive means including, but not limited to, a spring-, hydraulic-, gear-, or motorized type mechanisms mounted on the vehicle or carriage guide assembly of the present invention. Finally, a further advantage is that the present invention may be used on various types of augers without the need of additional adjustment to the present invention. The unique design of the automatically adjusting auger receiver assembly automatically adjusts to the varying dimensions of the operating handles of multiple pre-manufactured augers, allowing the auger unit to be supported and operated as it was designed by the manufacture, unlike previous inventions where the user must physically adjust the width of the supporting structure. These and other advantages of the present invention will become apparent upon review of the drawings, detailed description of the device, and the appended claims.

REFERENCE NUMBERALS IN DRAWINGS

Figure 1:
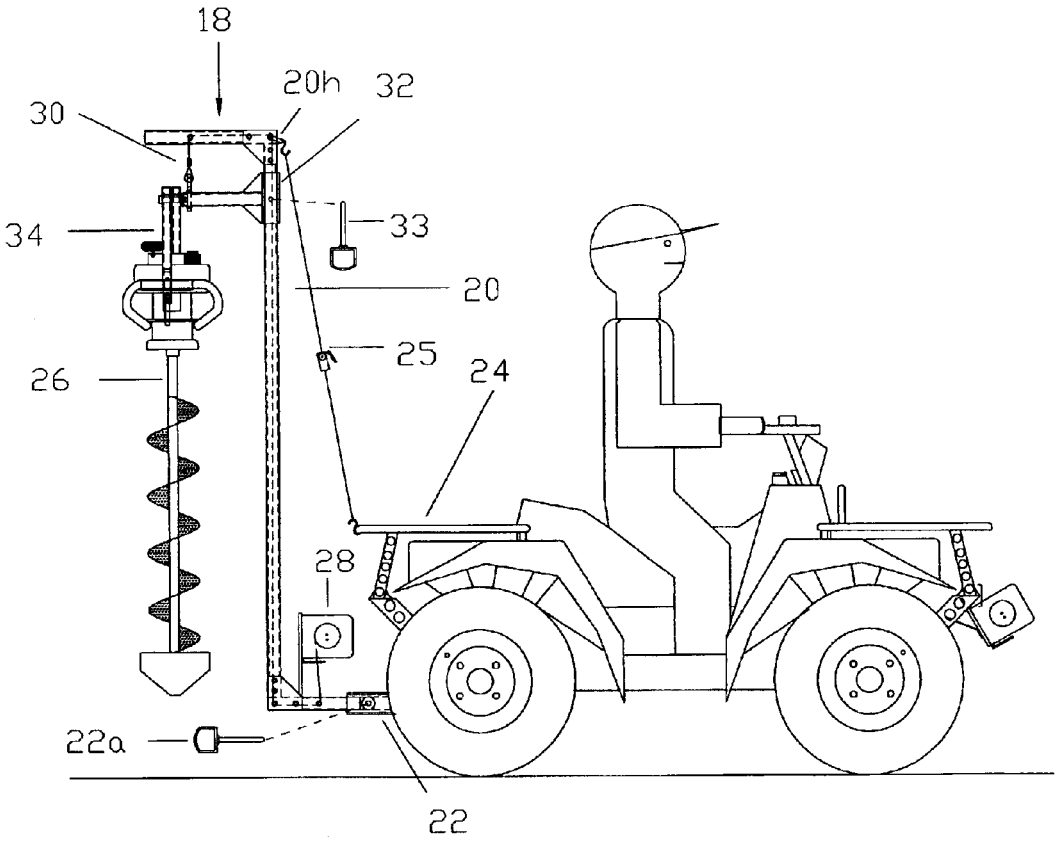
FIG. 1 is a side view of the present invention secured to an ATV while holding an auger in the fully raised position.
Figure 1A:
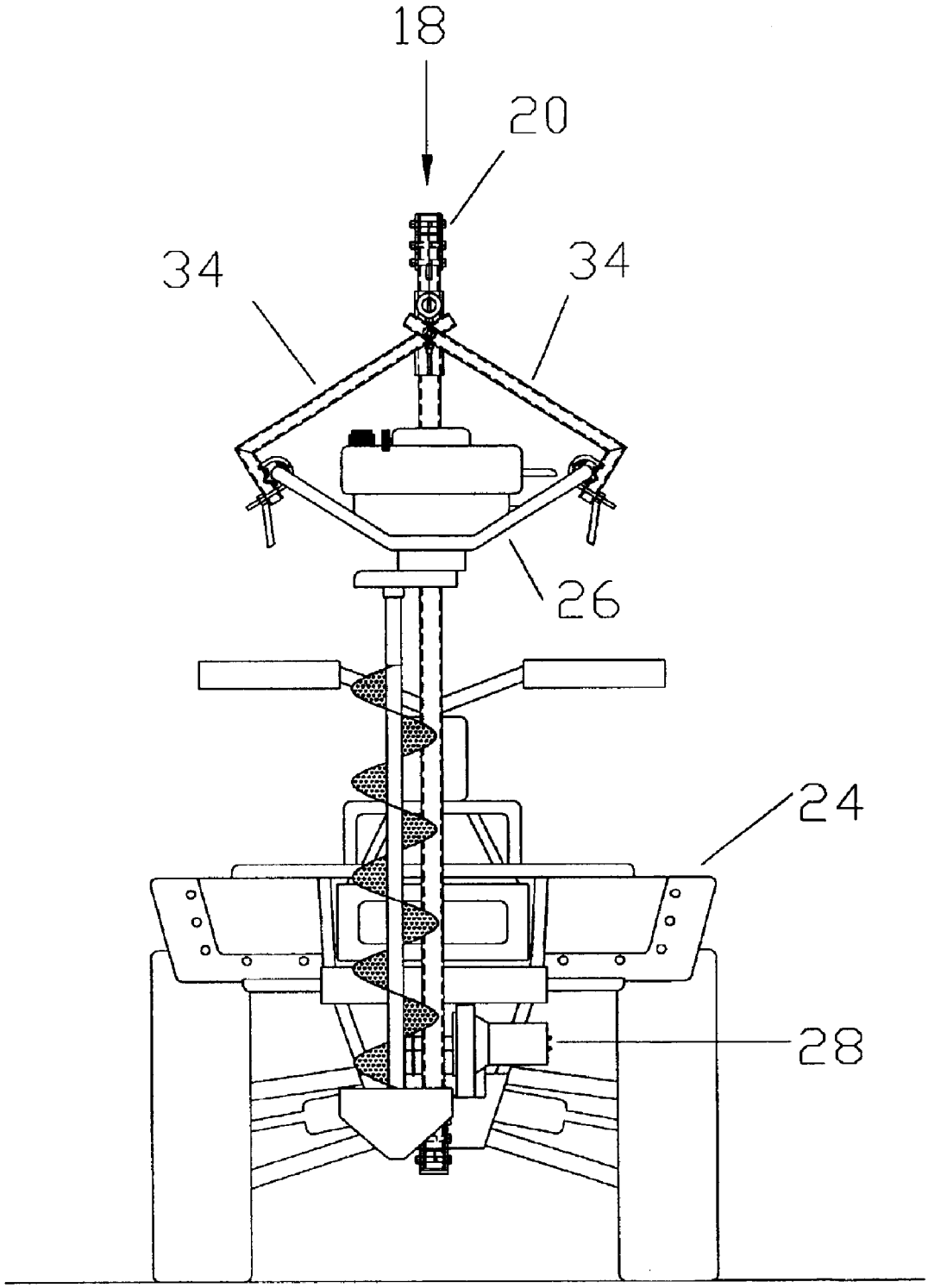
FIG. 1*a* is a front view of the present invention secured to an ATV while holding an ice auger in the fully raised position.

18 auger/vehicle interface jig
20 carriage guide assembly
20*a* carriage guide hitch adapter
20*b* carriage guide lower horizontal support
20*c* carriage guide stiffener plate
20*d* carriage guide vertical support
20*e* carriage guide upper horizontal support
20*f* carriage guide assembly bolt
20*g* carriage guide assembly nut
20*h* carriage guide bracing clevis
22 square tubular style vehicle hitch
22*a* hitch pin
24 vehicle
25 stiffener strap (optional)
26 auger
28 power unit (in this case a winch)
30 power unit linkage (in this case a winch cable)
32 sliding carriage assembly
32*a* sliding carriage assembly vertical support
32*b* sliding carriage assembly stiffener gusset
32*c* sliding carriage assembly horizontal support
32*d* sliding carriage assembly power unit linkage interface
32*e* sliding carriage assembly power unit linkage interface securing nut
32*f* sliding carriage assembly end plate
32*g* automatically adjusting auger receiver pivoting pin receiver
33 transport locking pin
34 automatically adjusting auger receiver assembly
34*a* automatically adjusting auger receiver vertical support member
34*b* automatically adjusting auger receiver horizontal support member
34*c* automatically adjusting auger receiver base gripper angle
34*d* automatically adjusting auger receiver top gripper angle
34*e* automatically adjusting auger receiver gripper cushion
34*f* automatically adjusting auger receiver fastening bolt
34*g* automatically adjusting auger receiver fastening handle
34*h* automatically adjusting auger receiver pivot pin
34*j* automatically adjusting auger receiver thrust washer

DETAILED DESCRIPTION OF THE INVENTION

Figure 2:
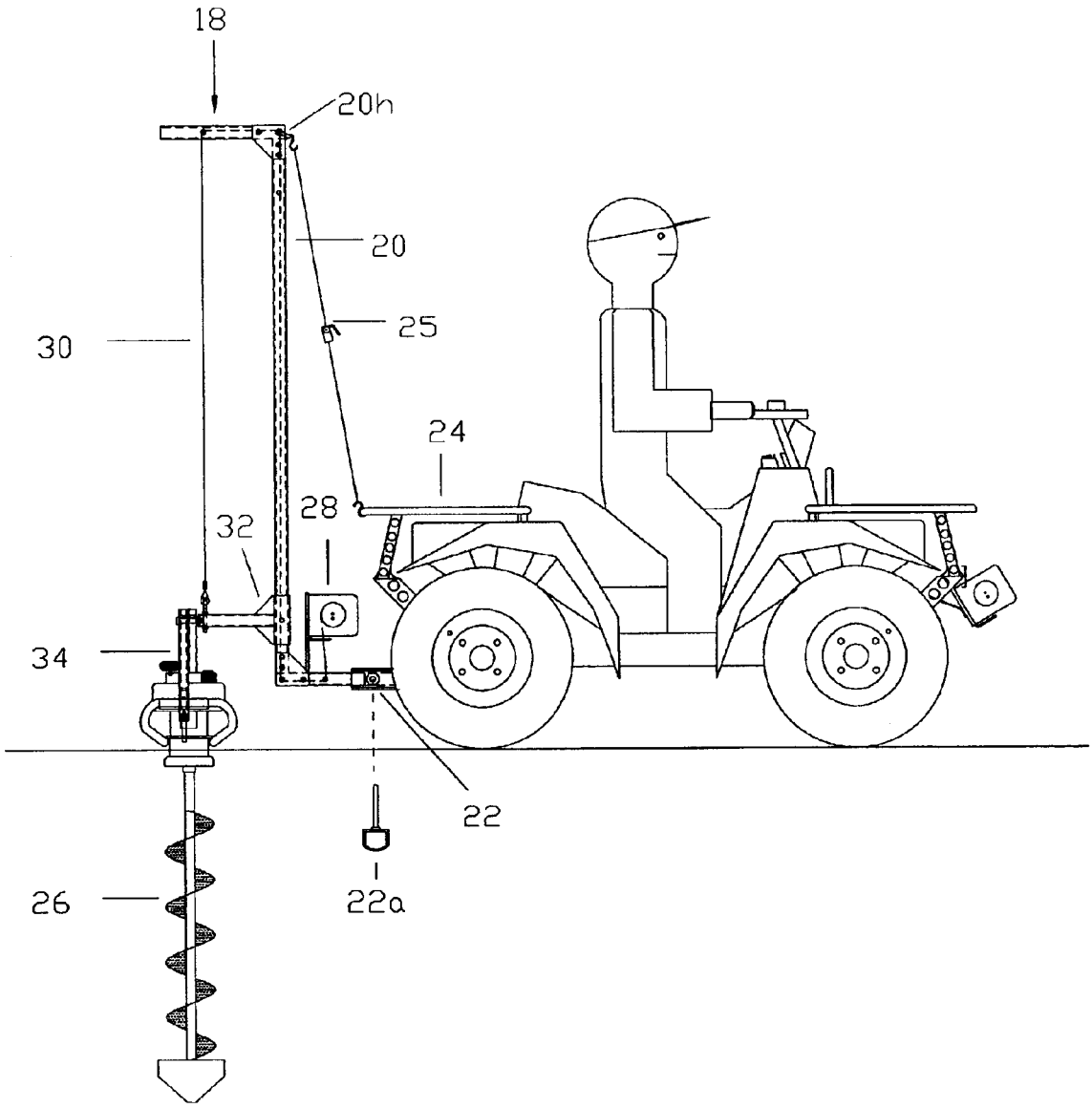
FIG. 2 is a side view of the present invention secured to an ATV while holding an auger in the fully lowered position.
Figure 2A:
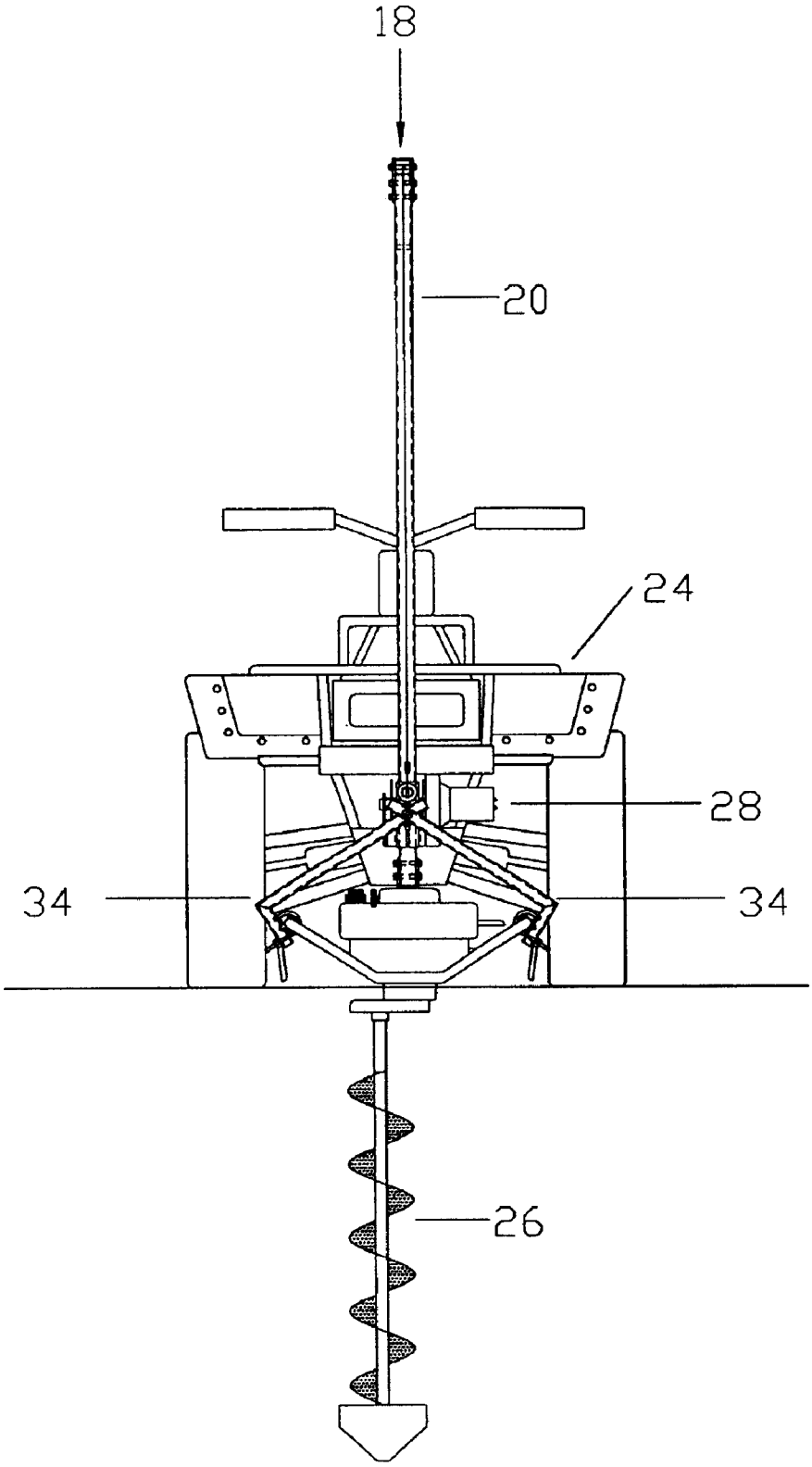
FIG. 2*a* is a front view of the present invention secured to an ATV while holding an ice auger in the fully lowered position.

The preferred embodiment of the present invention is illustrated in FIGS. 1 through 10. FIGS. 1 through 2*a* show various views of a basic version of the auger/vehicle interface jig 18 in various states of use. The three main components or assemblies of the auger/vehicle interface jig 18 are illustrated in these same figures and consist of a carriage guide assembly 20, a sliding carriage assembly 32 and an automatically adjusting auger receiver assembly 34. The sliding carriage assembly 32 is affixed to the carriage guide assembly 20 by such means that it is able to move vertically up and down along the vertical support 20*d* of the carriage guide assembly 20. The automatically adjusting auger receiver assembly 34 is then connected to the opposite end of the sliding carriage assembly 32. The auger/vehicle interface jig 18 is made of tubular steel, however, it is to be understood that all or portions of the auger/vehicle interface jig 18 may be made from materials such as other formed or extruded metals (such as aluminum) and or plastics (including fiberglass), or the like, having sufficient strength to support the auger 26 and the vibration associated with its use. The auger/vehicle interface jig 18 attaches to a vehicle 24 through the vehicle hitch 22. Whereas FIGS. 1 through 2*a* show the vehicle 24 as an All-Terrain Vehicle (ATV) it should be understood that the said vehicle 24 could be any type of vehicle including snowmobile, tractor, car or truck. The auger/vehicle interface jig 18 is further secured to the vehicle 24 with a hitch pin 22*a*. Further support for the auger/vehicle interface jig 18 is provided with the use of an optional readily available off the shelf adjustable belt, cord or stiffener strap 25 when it is attached to the vehicle 24 and to the auger/vehicle interface jig 18 through the carriage guide bracing clevis 20*h*. A locking means for securing the sliding carriage assembly 32 to the carriage guide assembly 20 when the sliding carriage assembly 32 is in the fully raised position is provided by the transport locking pin 33. It should be understood that the transport locking pin 33 is only used when the auger/vehicle interface jig 18 is being transported over long distances by the vehicle 24 and must be removed when actually performing the digging operation. The auger, drill, hole digger 26 is attached to the auger/ vehicle interface jig 18 through the automatically adjusting auger receiver assembly 34. An optional power unit 28, for the purpose of assisting in the vertical motion of the auger 26 during the digging process, can be provided. Whereas FIGS. 1 through 6*a* show the power unit 28 as a winch it should be understood that said power unit 28 could be any type of powering means such as but not limited to hydraulic, pneumatic, motor driven gears, springs or devices of that nature. The power unit 28 is then connected to the sliding carriage assembly 32 by the means of a power unit linkage 30.

Figure 3:
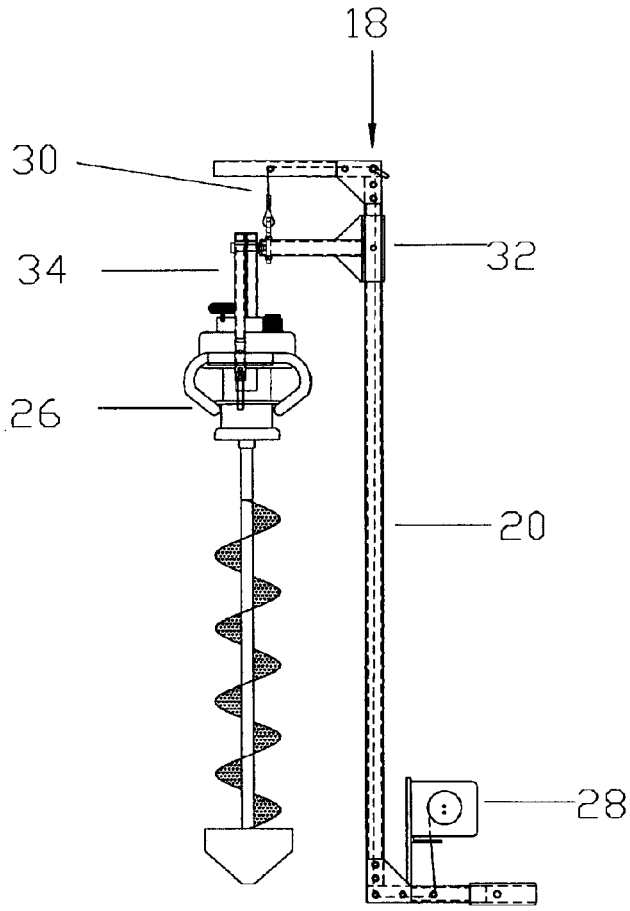
FIGS. 3 & 3*a* show a side and front view respectively of the present invention with an ice auger in the fully raised position.
Figure 3A:
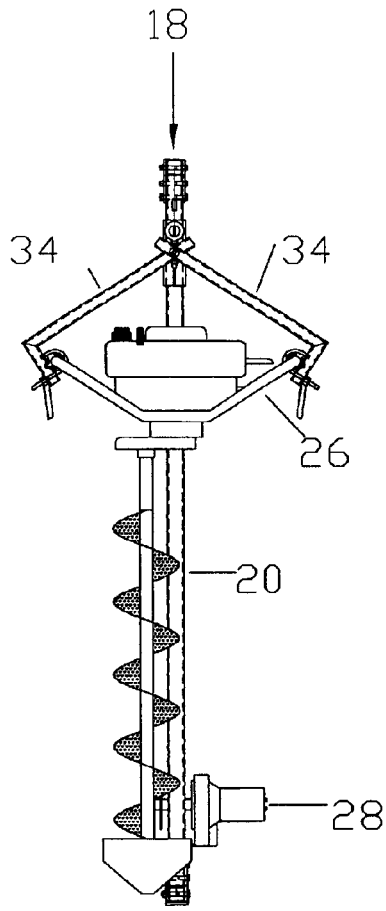
Figure 4:
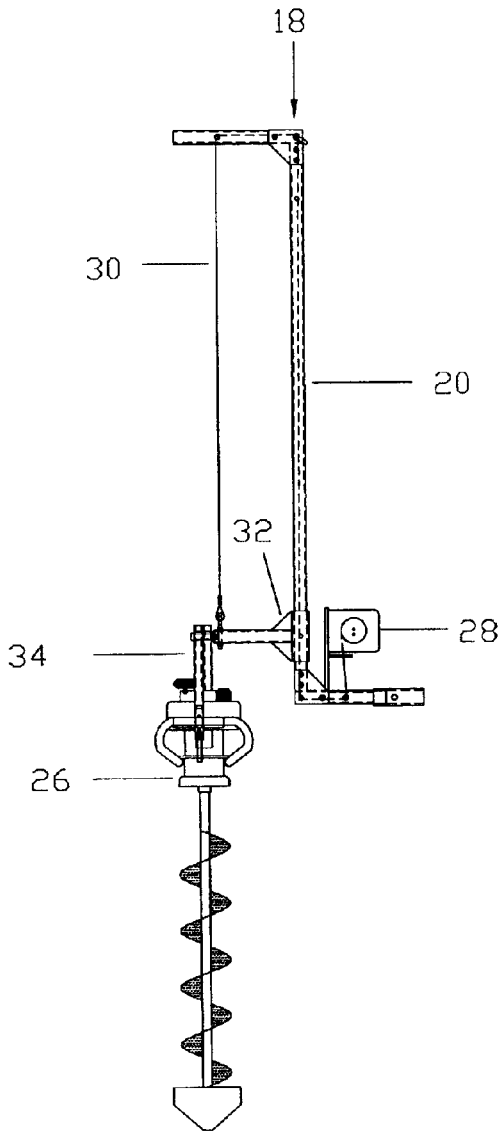
FIGS. 4 & 4*a* show a side and front view respectively of the present invention with an ice auger in the fully lowered position.
Figure 4A:
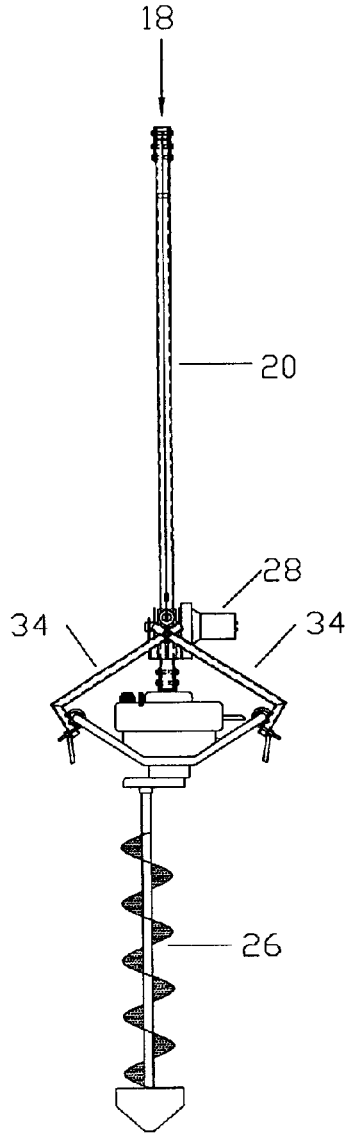

FIGS. 3 through 4*a* show various views of a basic version of an auger/vehicle interface jig 18 with an auger 26 and optional power unit 28. The vehicle 24 is not included in these figures for the purpose of clarity.

Figure 5:
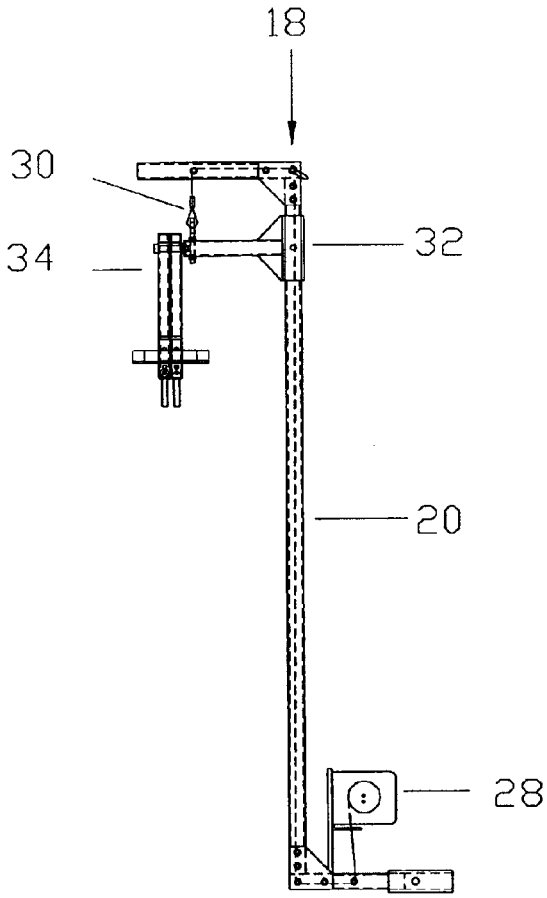
FIGS. 5 & 5*a* show a side and front view respectively of the present invention without an ice auger in the fully raised position.
Figure 5A:
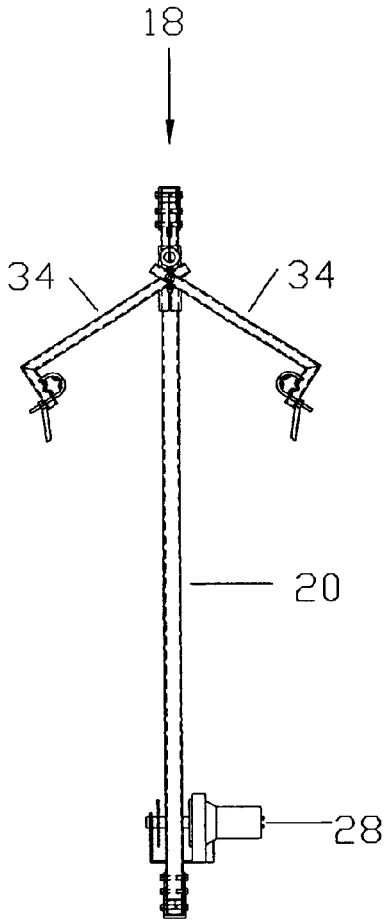
Figure 6:
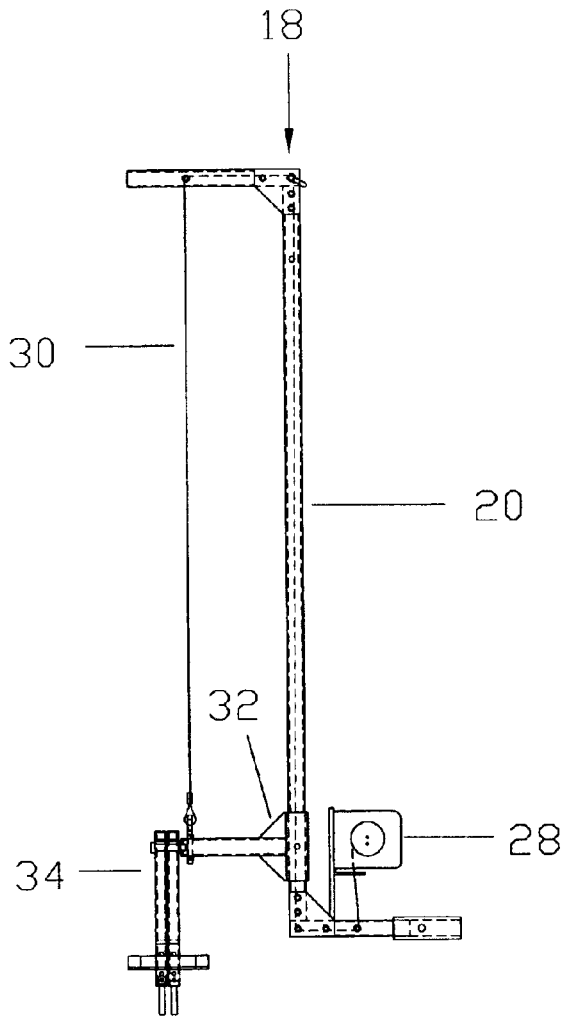
FIGS. 6 & 6*a* show a side and front view respectively of the present invention without an ice auger in the fully lowered position.
Figure 6A:
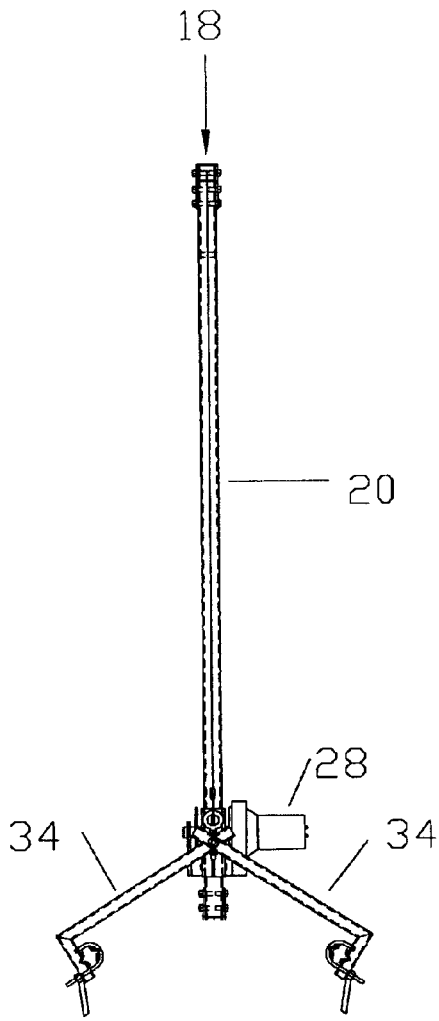

FIGS. 5 through 6*a* show various views of a basic version of an auger/vehicle interface jig 18 with an optional power unit 28. The vehicle 24 and the auger 26 are not included in these figures for the purpose of clarity.

Figure 7:
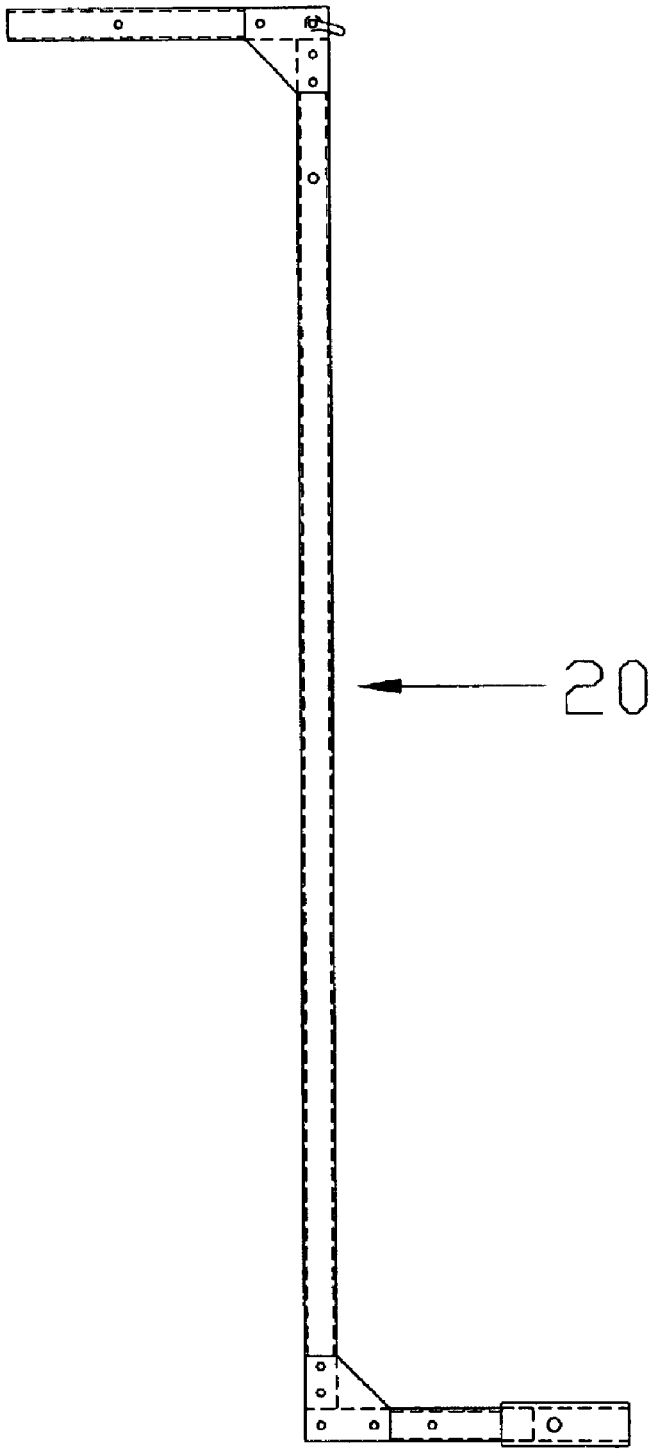
FIG. 7 shows a side view of the carriage guide assembly.
Figure 7A:
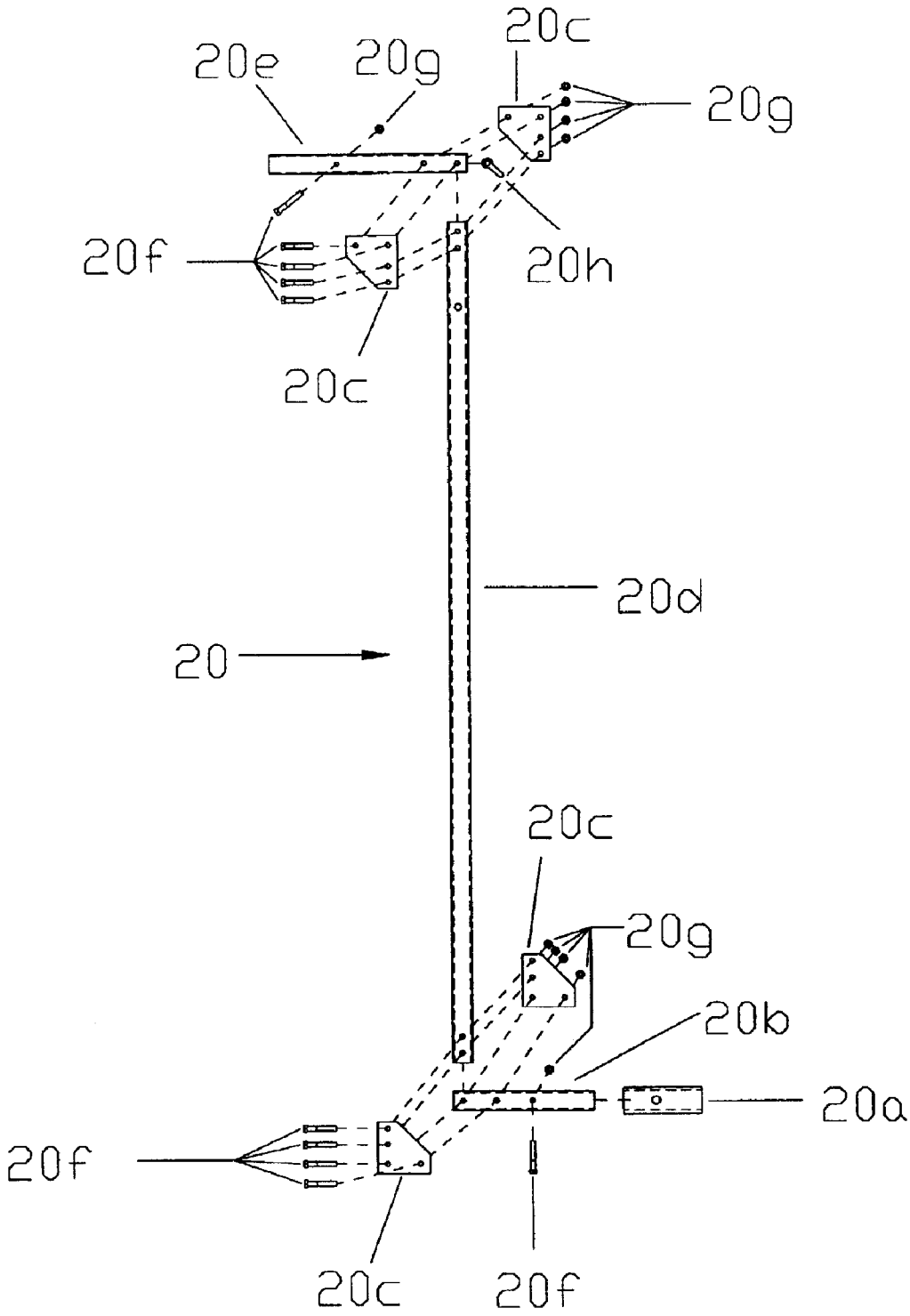
FIG. 7*a* shows an exploded side view of the carriage guide assembly.

FIG. 7 shows a side view of the first main assembly, the carriage guide assembly 20. FIG. 7*a* shows an exploded side view of the carriage guide assembly 20. In FIG. 7*a* the carriage guide assembly 20 consists of a carriage guide hitch adapter 20*a* which is affixed to the carriage guide lower horizontal support 20*b*. The carriage guide lower horizontal support 20*b* is then fastened to the carriage guide vertical support 20*d* by two carriage guide stiffener plates 20*c* and four carriage guide assembly bolts 20*f* and four carriage guide assembly nuts 20*g*. The top of the carriage guide vertical support 20*d* is fastened to the carriage guide upper horizontal support 20*e* by two carriage stiffener plates 20*c* and four carriage guide assembly bolts 20*f* and four carriage guide assembly nuts 20*g*. Prior to this the carriage guide bracing clevis 20*h* is inserted into the open end of the carriage guide horizontal support 20*e* and is secured by one of the four bolts mentioned above. Additional carriage guide assembly bolts 20*f* are inserted through both the carriage guide upper horizontal support 20*e* and the carriage guide lower horizontal support 20*b* and secured with carriage guide assembly nuts 20*g*. The purpose of these two bolts is to provide a guiding means for the optional power unit linkage 30. (Not shown on this drawing, refer to FIG. 2.)

Figure 8:
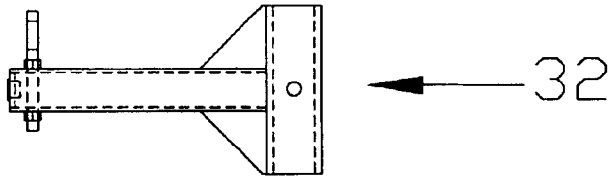
FIG. 8 shows a side view of the sliding carriage assembly.
Figure 8A:
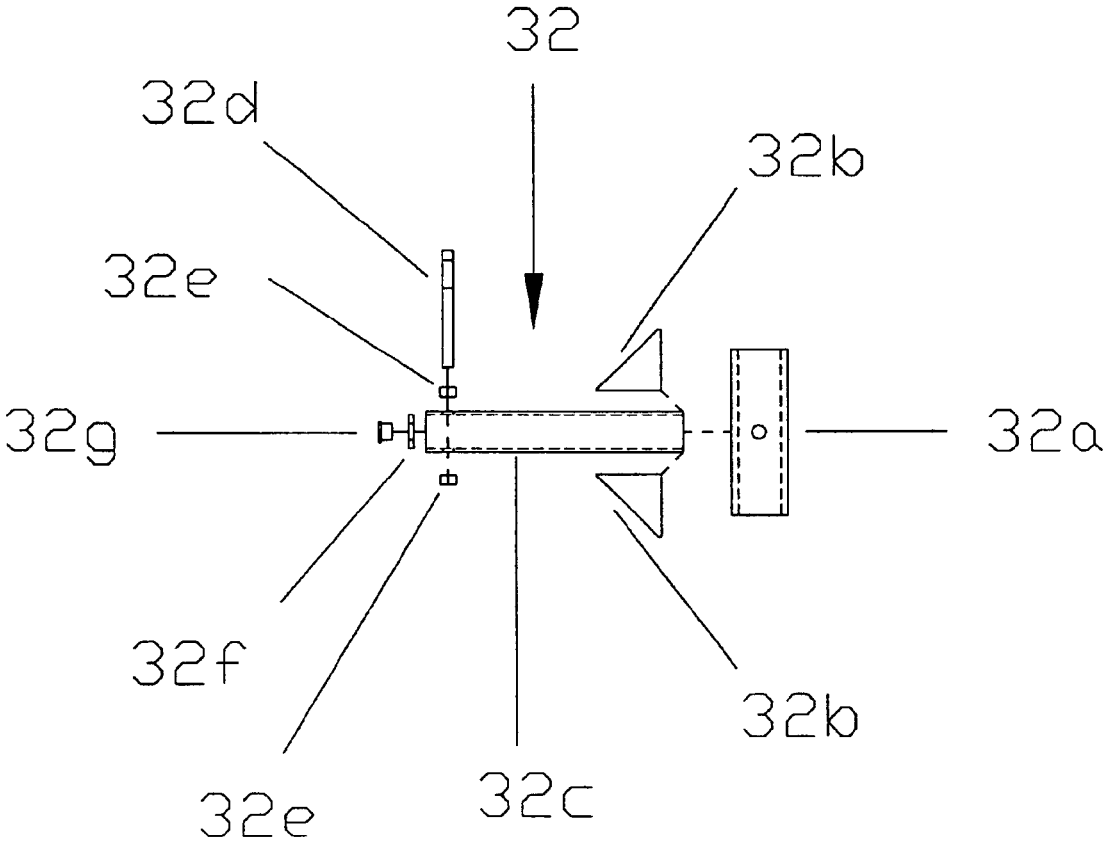
FIG. 8*a* shows an exploded side view of the sliding carriage assembly.

FIG. 8 shows the side view of the second main assembly, the sliding carriage assembly 32. FIG. 8*a* shows an exploded side view of the sliding carriage assembly 32. The sliding carriage assembly vertical support 32*a* is affixed to the sliding carriage assembly horizontal support 32*c*. In each of the two 90 degree corners formed by this union a sliding carriage stiffener gusset 32*b* is attached and affixed to both the sliding carriage assembly vertical support 32*a* and the sliding carriage assembly horizontal support 32*c*. At the opposite open end of the sliding carriage assembly horizontal support 32*c* the sliding carriage assembly end plate 32*f* is inserted and affixed. Into the sliding carriage assembly endplate 32*f* the automatically adjusting auger receiver pivoting pin receiver 32*g* is inserted and affixed. At this same end of the sliding carriage assembly horizontal support 32*c* the sliding carriage assembly power unit linkage interface 32*d* is inserted and fastened with the use of two sliding carriage assembly power unit linkage interface securing nuts 32*e*.

Figure 9:
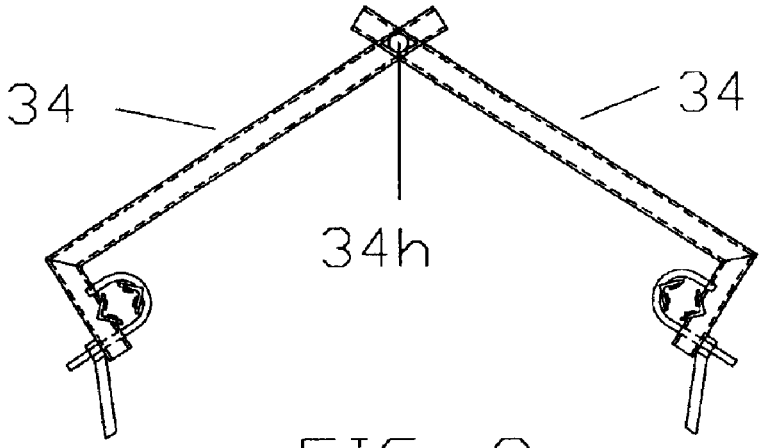
FIG. 9 shows a front view of an automatically adjusting auger receiver assembly.
Figure 9B:
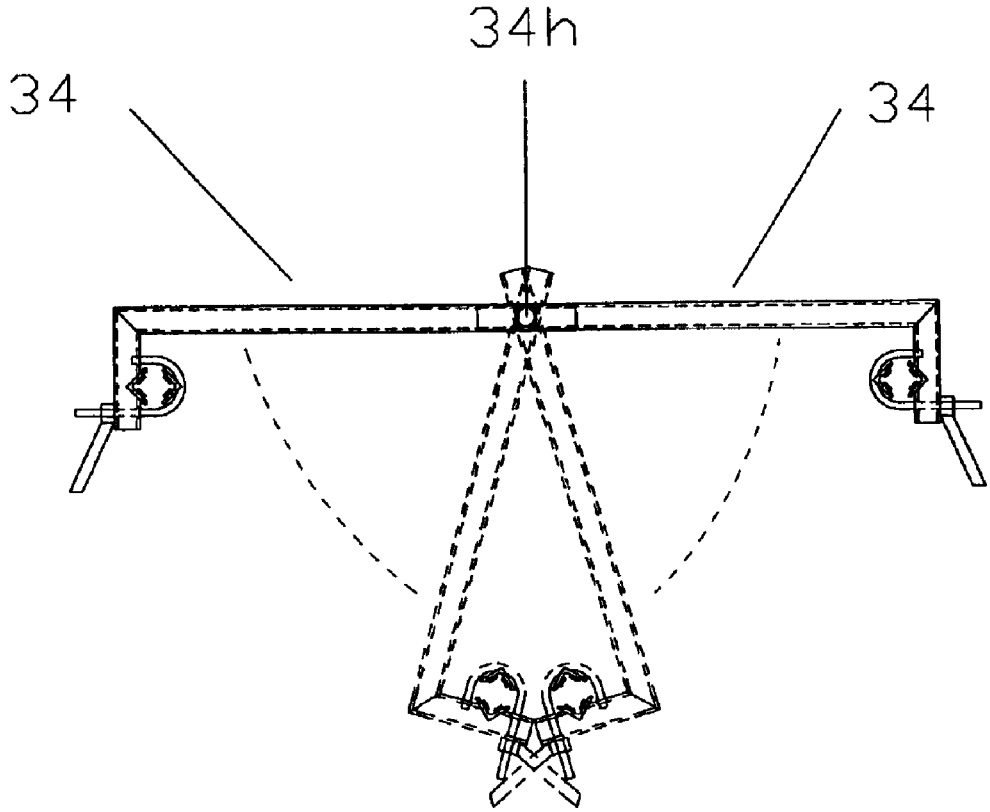
FIG. 9*b* shows the range of motion for an automatically adjusting auger receiver assembly.
Figure 9A:
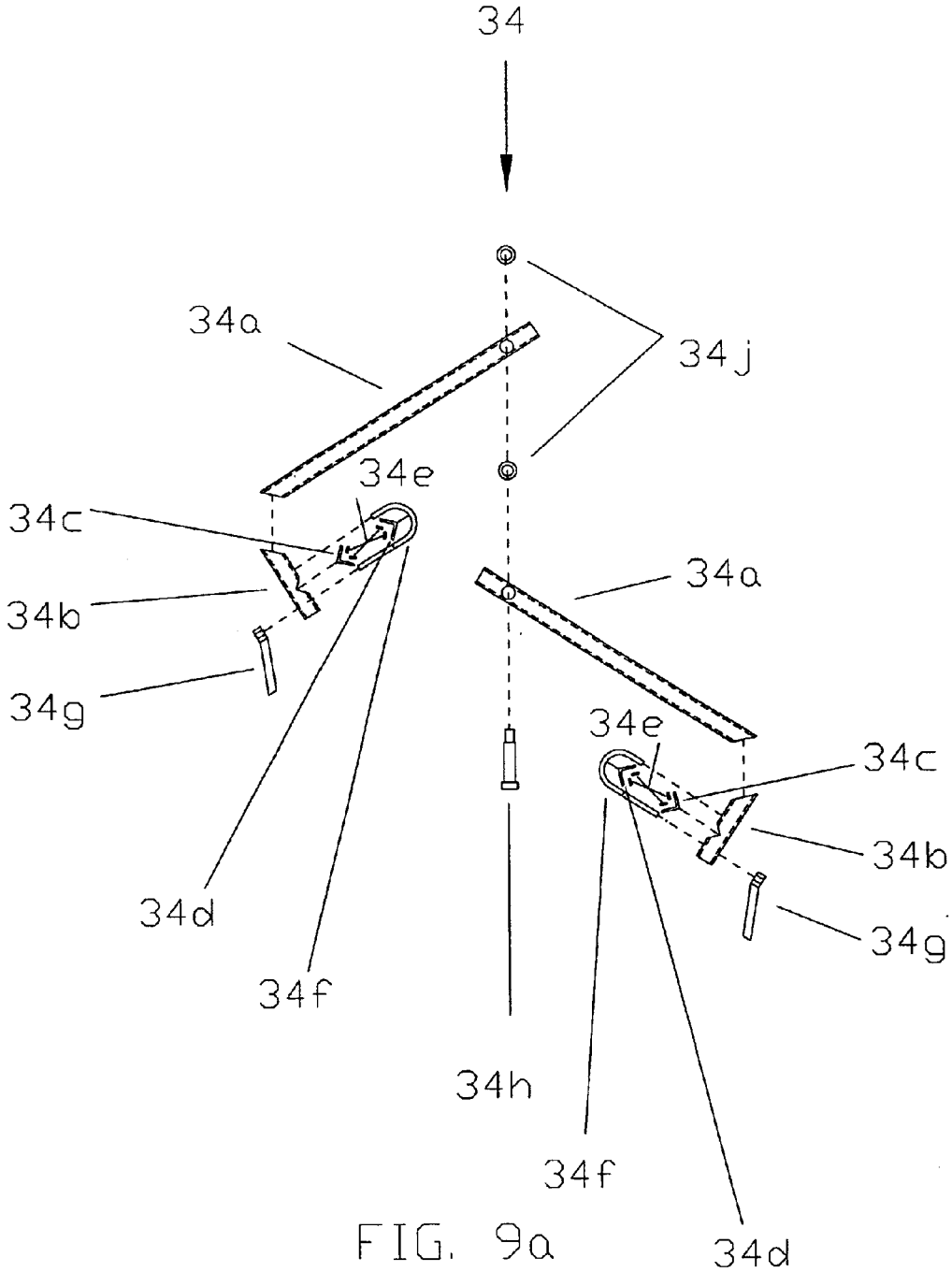
FIG. 9*a* shows an exploded front view of an automatically adjusting auger receiver assembly.

FIG. 9 shows a front view of the third main assembly, the automatically adjusting auger receiver assembly 34. FIG. 9*a* shows an exploded front view of the automatically adjusting auger receiver assembly 34. In FIG. 9*a* the automatically adjusting auger receiver assembly 34 consists of two automatically adjusting auger receiver vertical support members 34*a*, one right hand and one left hand, each of which are affixed to an automatically adjusting auger receiver horizontal support member 34*b*. Affixed to each automatically adjusting auger receiver horizontal support member 34*b* are the automatically adjusting auger receiver base gripper angles 34*c*. Each automatically adjusting auger receiver horizontal support member 34*b* then receives an automatically adjusting auger receiver fastening bolt 34*f* which passes through each of the automatically adjusting auger receiver horizontal support members 34*b* which are then secured by the automatically adjusting auger receiver fastening handles 34*g*. The automatically adjusting auger receiver top gripper angle 34*d* is then affixed to the inside radius of the automatically adjusting auger receiver fastening bolt 34*f*. Affixed to the inside flanges of both the automatically adjusting auger receiver base gripper angle 34*c* and the automatically adjusting auger receiver top gripper angle 34*d* is the automatically adjusting auger receiver gripper cushion 34*e*. Both of the automatically adjusting auger receiver vertical support members 34*a* are then attached to the automatically adjusting auger receiver pivoting pin receiver 32*g* (not shown in this drawing, reference FIG. 8*a*) by the automatically adjusting auger receiver pivot pin 34*h*. Two automatically adjusting auger receiver thrust washers 34*j* complete this assembly, one of which resides between each of the two automatically adjusting auger receiver vertical support members 34*a* and the other resides between the left hand automatically adjusting auger receiver vertical support member 34*a* and the automatically adjusting auger receiver pivoting pin receiver 32*g* (not shown in this drawing, reference FIG. 8*a*). FIG. 9*b* shows the full range of motion of the automatically adjusting auger receiver assembly 34 which in turn displays the flexibility of the auger/vehicle interface jig's 18 ability to adapt to varying auger handle widths and configurations.

Figure 10:
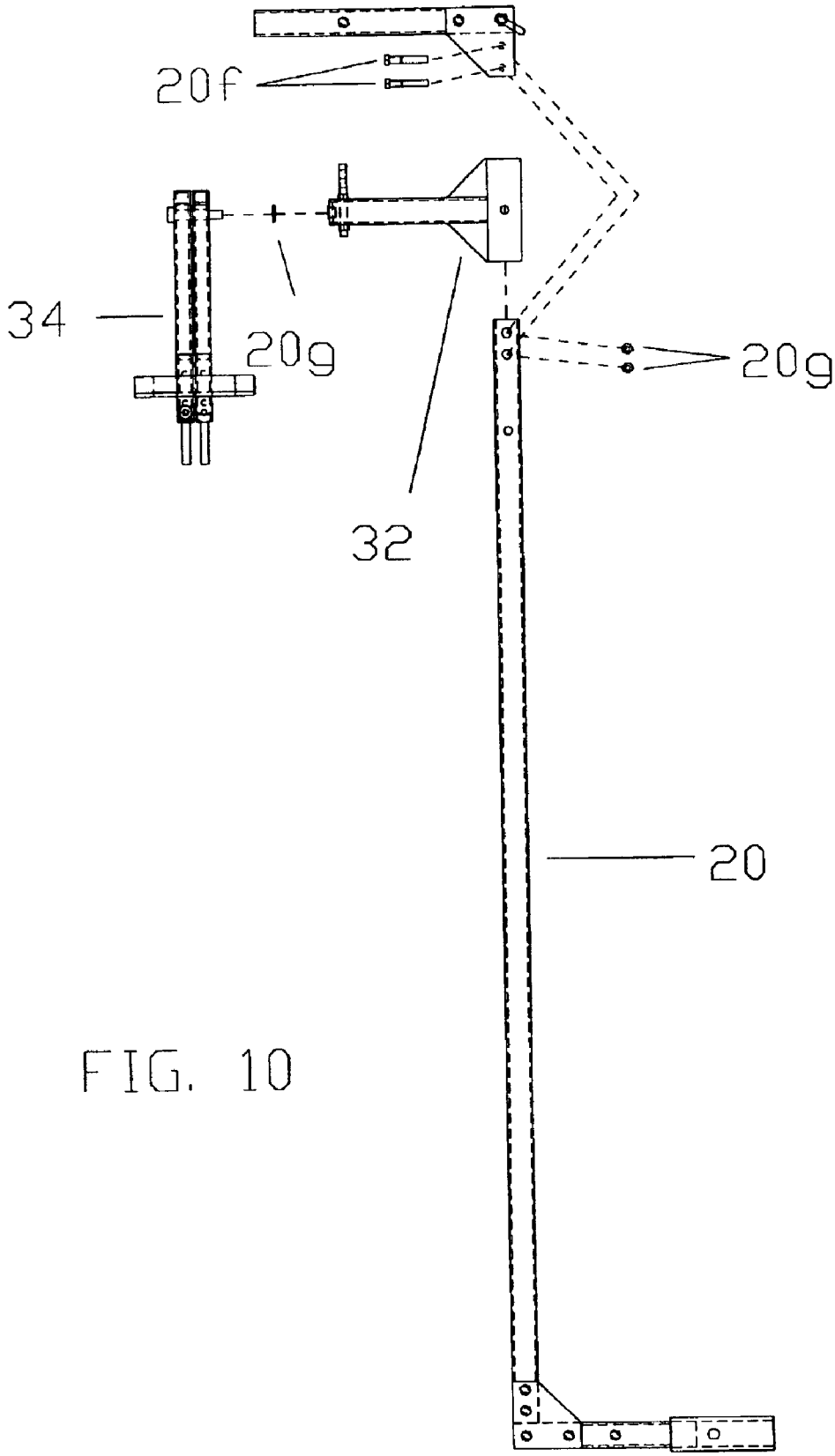
FIG. 10 shows an exploded side view of the present invention, showing the assembly of the units three sub-assemblies (the carriage guide assembly, sliding carriage assembly and automatically adjusting auger receiver assembly).

FIG. 10 shows the assembly of the three main components of the auger/vehicle interface jig 18. During the assembly of the carriage guide assembly 20 the sliding carriage assembly 32 is joined with the carriage guide vertical support 20*d* then, the assembly of the carriage guide assembly 20 is completed as described above. The automatically adjusting auger receiver assembly 34 is then fastened to sliding carriage assembly 32 by the automatically adjusting auger receiver pivot pin 34*h* (not shown in this drawing, reference FIG. 9*a*).

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

We claim:

1. An interface jig for removably securing a portable auger to a vehicle comprising:

a carriage guide assembly including a vertical support having an upper portion and a bottom portion, wherein a hitch adapter is affixed to the bottom portion to secure the carr age guide assembly to a vehicle hitch receiver;

a sliding carriage assembly including a horizontal member having a first end opposite a second end, wherein the first end is affixed to a vertical member that slides along the vertical support between the upper portion and the lower portion of the carriage guide; and a receiver assembly coupled to the second end of the sliding carriage assembly wherein the receiver assembly includes a pair of pivoting vertical support members, wherein each of the vertical support members are affixed to the sliding carriage assembly at a common point.

2. The interface jig according to claim 1, wherein the vertical support is noncircular.

3. The interface jig according to claim 1, wherein the vertical member of the sliding carriage assembly substantially encapsulates the vertical support of the carriage guide assembly.

4. The interface jig according to claim 1, wherein the receiver assembly includes a horizontal member attached to each of the vertical support members.

5. The interface jig according to claim 4, wherein each of the horizontal members of the receiver assembly receives a fastening bolt that passes through each horizontal support member.

6. The interface jig according to claim 5, wherein each of the horizontal members of the receiver assembly is affixed to a gripper cushion and a fastening handle.

* * * * *